US009367006B2

(12) United States Patent
Yoshida et al.

(10) Patent No.: US 9,367,006 B2
(45) Date of Patent: Jun. 14, 2016

(54) IMAGE HEATING APPARATUS INCLUDING A COVERING MEMBER CONFIGURED TO COVER AN ELECTRODE PORTION

(71) Applicant: CANON KABUSHIKI KAISHA, Tokyo (JP)

(72) Inventors: Keisuke Yoshida, Kashiwa (JP); Takatoshi Chiba, Kashiwa (JP); Youichi Chikugo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/096,461

(22) Filed: Dec. 4, 2013

(65) Prior Publication Data

US 2014/0161479 A1 Jun. 12, 2014

(30) Foreign Application Priority Data

Dec. 11, 2012 (JP) ..... 2012-270304

(51) Int. Cl.
*G03G 15/20* (2006.01)
*G03G 21/16* (2006.01)

(52) U.S. Cl.
CPC ..... *G03G 15/2053* (2013.01); *G03G 21/1652* (2013.01); *G03G 2215/2035* (2013.01)

(58) Field of Classification Search
CPC ..... G03G 15/2053; G03G 21/1652
USPC ..... 399/90, 329
See application file for complete search history.

(56) References Cited

U.S. PATENT DOCUMENTS 4,791,608 A * 12/1988 Fushimoto
5,149,941 A 9/1992 Hirabayashi et al.
5,300,997 A 4/1994 Hirabayashi et al.
5,343,280 A 8/1994 Hirabayashi et al.
5,767,484 A 6/1998 Hirabayashi et al.
5,828,035 A * 10/1998 Kuroda
7,480,480 B2 1/2009 Endo et al.
7,505,725 B2 3/2009 Katayama et al.
7,546,078 B2 6/2009 Okuda et al.
7,554,813 B2 * 6/2009 Miller et al.

(Continued)

FOREIGN PATENT DOCUMENTS

JP 63-313182 A 12/1988
JP 01154800 A * 6/1989

(Continued)

OTHER PUBLICATIONS

Jul. 28, 2015 Office Action in counterpart Chinese Patent Application No. 201310671761.5 and English translation thereof.

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An image heating apparatus includes: an endless belt; a rotatable member configured to cooperate with the endless belt to form the nip; a back-up member including a heater and an electrode portion connected with the heater; an electric energy supply member mounted to the back-up member; a regulating member mounted to the back-up member to regulate movement of the endless belt in a longitudinal direction of the belt; and a covering member for covering the electrode portion when the endless belt is inserted and removed in a longitudinal direction in the state that the electric energy supply member and the regulating member are dismounted from the back-up member.

7 Claims, 11 Drawing Sheets

(a)

(b)

(56) References Cited

U.S. PATENT DOCUMENTS

| | | | |
|---|---|---|---|
| 7,890,024 | B2 | 2/2011 | Hirayama et al. |
| 7,890,038 | B2 | 2/2011 | Chikugo et al. |
| 8,095,058 | B2 | 1/2012 | Chiba |
| 2013/0142552 | A1 | 6/2013 | Yoshida |
| 2013/0279953 | A1 | 10/2013 | Chikugo |
| 2014/0105634 | A1 | 4/2014 | Tanaka et al. |

FOREIGN PATENT DOCUMENTS

| | | | | |
|---|---|---|---|---|
| JP | 06194977 | A | * | 7/1994 |
| JP | 10-171276 | A | | 6/1998 |
| JP | 2006011921 | A | * | 1/2006 |

* cited by examiner (a)

(b)

(a)

(b)

(a)

(b)

IMAGE HEATING APPARATUS INCLUDING A COVERING MEMBER CONFIGURED TO COVER AN ELECTRODE PORTION

FIELD OF THE INVENTION AND RELATED ART

The present invention relates to an image heating apparatus which heats the toner image on a sheet of recording medium.

It has been a common practice to provide an electrophotographic image forming apparatus with a fixing apparatus (device) for fixing the toner image formed on a sheet of recording medium to the sheet of recording medium.

An example of a fixing apparatus employed by an electrophotographic image forming apparatus is disclosed in Japanese Laid-open Patent Application Sho63-313182. This fixing apparatus employs a fixing film (endless belt). More concretely, it is provided with the fixation film, a heater (which is thin and flat in shape), and a pressure roller. It is structured so that the fixation film is sandwiched by the heater and pressure roller, forming a nip in which a sheet of recording medium is conveyed while being heated.

There is disclosed another fixing device such as the above described one in Japanese Laid-open Patent Application Hei10-171276. This fixing apparatus is structured so that its fixation film is replaceable. Therefore, if it becomes unsatisfactory in performance because of the deterioration of its fixation film, all that is necessary is to replace the fixation film; it is unnecessary to replace the entirety of the fixing device.

More specifically, this fixing apparatus is provided with a portion through which electric power is supplied to its heater, and a power supplying connector (power supplying member) which can be connected to, or disconnected, from the portion through which the electric power is supplied to the heater, and from which electric wire extends. Here, referring to FIG. 15, the procedure for replacing the fixation film of this fixing apparatus is described.

Referring to FIG. 15, when it is necessary to replace the fixation film 100, first, the power supply connector 112 is to be disengaged from the electrode portion 105*a* of the heater 105, in order to prevent the power supply connecter 112 from interfering with the operation for replacing the fixation film (Step 1). Then, the flange 102 (regulating member) which regulates the fixation film 100 in movement in terms of the lengthwise direction of the fixation film 100 is to be removed (Step 2). Then, the fixation film 100 is to be extracted in the direction parallel to its lengthwise direction (Step 3).

In other words, this fixing apparatus is structured as described above, from the standpoint of reducing a fixing apparatus in the consumption of natural resource, and also, in operational cost. It is possible, however, that such a structural arrangement as the one described above will suffer from the following problems.

That is, when the fixation film is extracted from the fixing apparatus, the lubricant with which the inward surface of the fixation film is coated will adhere to (transfer onto) the electrode portion of the heater. As the lubricant adheres to the electrode portion of the heater, there is not going to be established proper electrical connection between the electrode portion of the heater and the electric power supplying portion of the apparatus main assembly. Therefore, it is possible that after the replacement of the fixation film, the fixation film will not be satisfactorily heated.

SUMMARY OF THE INVENTION

According to an aspect of the present invention, there is provided an image heating apparatus comprising an endless belt configured to heat a toner image on a sheet in a nip, wherein an inner surface of said endless belt is coated with a lubricant; a rotatable member configured to cooperate with said endless belt to form the nip; a back-up member cooperate with said rotatable member to sandwich said endless belt, said back-up member including a heater configured to heat said endless belt, and an electrode portion connected with said heater; an electric energy supply member dismountably mounted to said back-up member to supply electric power to said heater through said electrode portion; a regulating member dismountably mounted to said back-up member and configured to regulate movement of said endless belt in a longitudinal direction thereof; and a covering member configured and positioned to cover said electrode portion when said endless belt is inserted and removed in the longitudinal direction in a state that said electric energy supply member and said regulating member are dismounted from said back-up member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, some of the preferred embodiments of the present invention are described in detail with reference to the appended drawings.

Embodiment 1

Image Forming Apparatus

Figure 14:
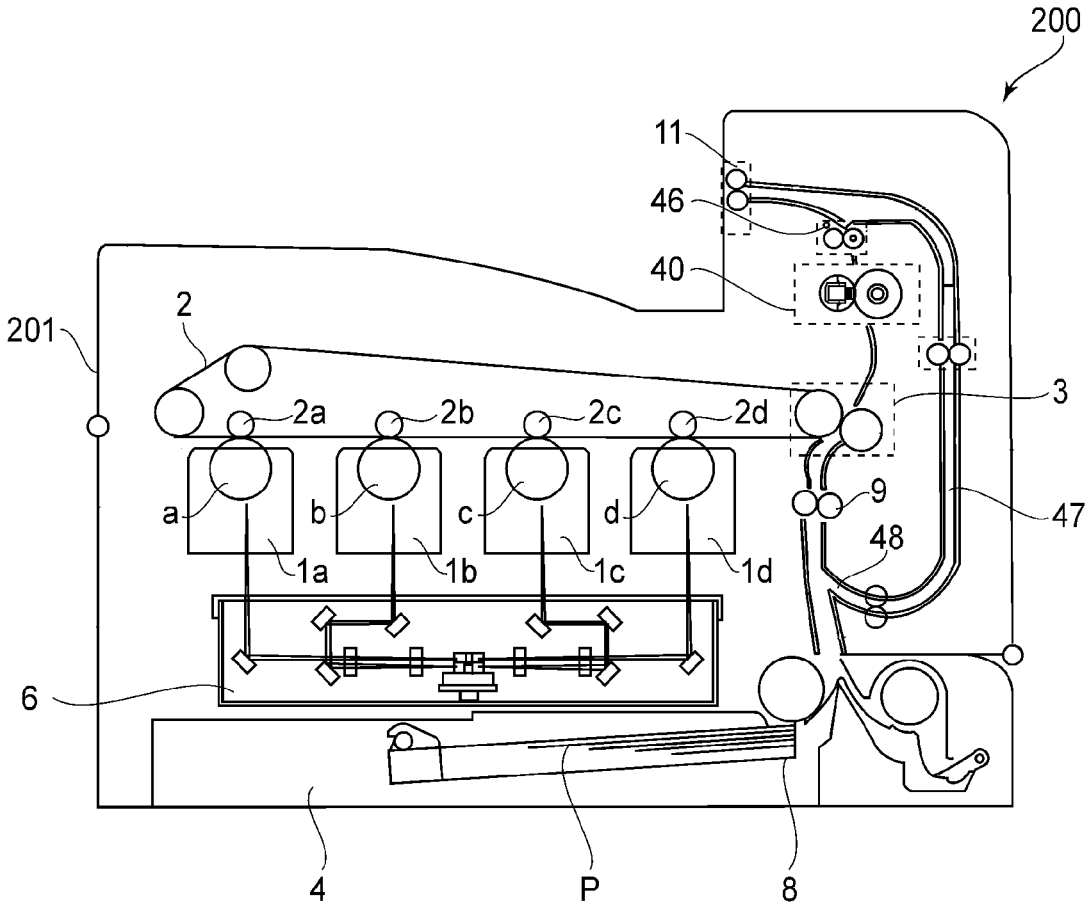
FIG. 14 is a schematic sectional view of the image forming apparatus in the first embodiment, which employs an image heating apparatus (device) in accordance with the present invention.

FIG. 14 shows the overall structure of the full-color laser beam printer as an example of a typical image forming apparatus to which the present invention is applicable. The image forming apparatus 200 is made up of an external shell 201, a scanner unit 6, a development unit, etc. It employs four process cartridges 1*a*, 1*b*, 1*c* and 1*d* which are for forming yellow, magenta, cyan, and black monochromatic images, respectively. The four process cartridges 1 are installed in the external shell 201 of the main assembly of the apparatus 200 so that they are positioned in parallel. Each process cartridge 1 is provided with a photosensitive drum (which hereafter will be referred to simply as drum) as an image bearing member which is rotatable in the clockwise direction by a drum driving means (unshown). Each process cartridge is also provided with a charging device and a development unit. The image forming apparatus 200 is structured so that after the proper installation of each cartridge into the external shell 201 of the image forming apparatus 200, the charging device, scanner unit 6, development unit, and the like processing means will be in the adjacencies of the drum, listing from the upstream side in terms of the rotational direction of the drum 1.

Further, the image forming apparatus 200 is provided with electrostatic transferring devices 2*a*, 2*b*, 2*c* and 2*d*, and a cleaning blade, which are positioned in the listed order in terms of the moving direction of the intermediary transfer belt 2.

The scanner unit 6 projects a beam of laser light upon the peripheral surface of each of the drums a, b, c and d while modulating the beam according to the information of the image to be formed, to form an electrostatic latent image on the peripheral surface of the drum. The scanner unit 6 is on the bottom side of the drums a, b, c and d in terms of the gravity direction. As development bias is applied to the development roller, which is positioned so that its peripheral surface opposes the peripheral surface of the corresponding drum, a toner image, which reflects the latent image, is formed on the peripheral surface of each of the drums a, b, c and d.

The electrostatic transferring devices 2*a*, 2*b*, 2*c* and 2*d* are devices for transferring the toner images on the drums a, b, c and d, respectively, onto a sheet P of transfer medium as recording medium. The image forming apparatus 200 has the intermediary transfer belt 2, which is circularly moved. The image forming apparatus 200 is structured so that when the four process cartridges 1*a*, 1*b*, 1*c* and 1*d* are properly positioned for image formation, in the main assembly of the image forming apparatus, the outward surface of the intermediary transfer belt 2 is in contact with the peripheral surface of each of the four drums a, b, c and d. The toner images on the drums a, b, c and d, one for one, are sequentially transferred onto the intermediary transfer belt 2 (primary transfer). Each of the electrostatic transferring devices 2*a*, 2*b*, 2*c* and 2*d* is provided with a transfer roller. The image forming apparatus 200 is structured so that the four transfer rollers are positioned in parallel, within the loop (belt loop) which the intermediary transfer belt 2 form, and oppose the drums a, b, c and d, one for one.

To these transfer rollers, bias which is positive in polarity is applied, providing thereby the belt 2 with positive electric charge, during the primary transfer. Thus, the toner images on the drums a, b, c and d, which are negative in polarity, are transferred, by the electrical field generated by the electric charge, onto the belt 2, with which the drums are in contact. Then, the toner images on the belt 2 are circularly moved with the belt 2 in the counterclockwise direction in the drawing, and are transferred onto a sheet P of recording medium by the secondary transferring device 3. The sheets P of recording medium are stored by multiple number in the sheet feeder cassette 4 in the sheet feeding-conveying portion 8 of the apparatus main assembly. The sheets P in the sheet feeder cassette 4 are fed into the apparatus main assembly one by one while being separated from the rest, and conveyed to the secondary transferring device 3.

After the transfer of the toner images on the drums a, b, c and d onto the sheet P of recording medium, the sheet P is conveyed through the fixing device 40, which functions as an image heating device, with which the image forming apparatus 200 is provided. While the sheet P is conveyed through the fixing device 40, it and the multiple toner images thereon, different in color, are subjected to heat and pressure, whereby the toner images are fixed to the surface of the sheet P. After the thermal fixation of the toner images to the sheet P, the sheet P is discharged from the apparatus main assembly of the image forming apparatus 200 by the pair of discharge rollers 11, with which the apparatus main assembly is provided.

Figure 2:
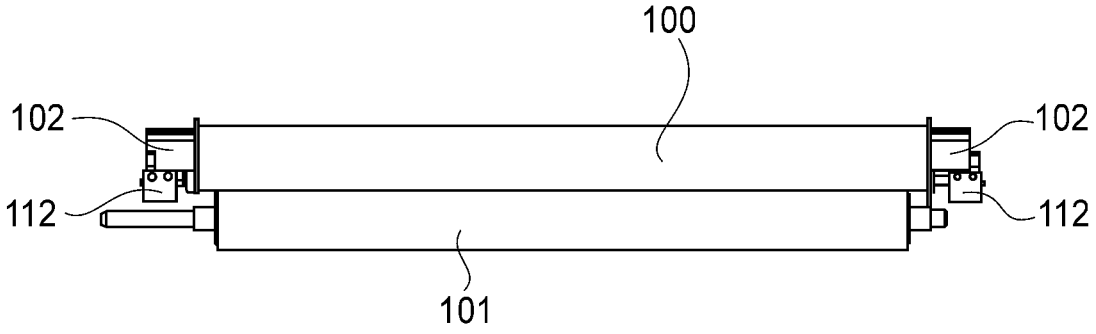
In FIG. 2, (a) is a plan view of the entirety of the image heating apparatus in the first embodiment, as seen from the direction from which a sheet of recording medium is fed into the apparatus, and in FIG. 2, (b) is a plan view of the image heating apparatus (device), minus its electrode protecting member, in the first embodiment, as seen from the direction perpendicular to the lengthwise direction of the apparatus.
Figure 2:
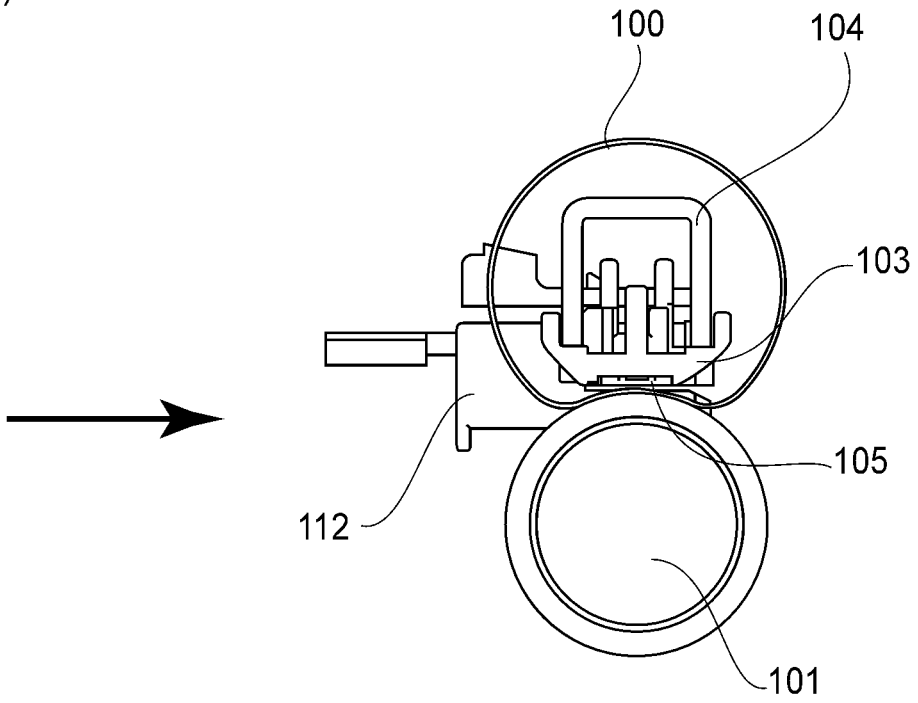

A referential code 47 in FIG. 2 stands for the sheet passage through which a sheet P of recording medium is conveyed when the image forming apparatus 200 is operated in the two-sided printing mode. When the image forming apparatus 200 is in the two-sided printing mode, each sheet P of recording medium is guided upward through the recording medium conveyance passage 48, as it comes out of the fixing device 40. Then, as the trailing edge of the sheet P arrives at the sheet reversal point, the sheet conveyance passage 48 is switched in its sheet conveyance direction so that the sheet P is conveyed in the opposite direction from the direction in which the sheet P has been conveyed. Consequently, the sheet P enters the two-sided printing mode sheet passage 47. Then, the sheet P is conveyed into the recording medium conveyance passage 48 for the second time, and is conveyed to the secondary transfer station 3 while remaining upside down.

Thus, a toner image (toner images) is transferred onto the second surface of the sheet P of recording medium. After the sheet P is conveyed out of the secondary transferring station, it is guided into the fixing device 40. After being conveyed through the fixing device 40, that is, after the image formation on both surfaces of the sheet P, the sheet P is discharged from the apparatus main assembly of the image forming apparatus 200 as it is when the image forming apparatus 200 is in the one-sided printing mode.

(Fixing Device)

Next, the fixing device 40 as an image heating apparatus (device) is concretely described. FIG. 2(*b*) is a sectional view of the fixing device 40 in this embodiment, as seen from the direction parallel to the lengthwise direction of the fixing device 40. FIG. 2(*a*) is a plan view of the fixing device 40 as seen from the direction indicated by an arrow mark in FIG. 2(*b*). The fixing device 40 is provided with a heater 105, a fixation film 100, and a pressure roller 101. The heater 105, which is a heat generating member, is in the form of a thin rectangular parallelepiped. The fixation film 100 is an endless belt, and is heated by the heater 105. The pressure roller 101 is a rotational member. It forms a nip between itself and the fixation belt 100. After the transfer of a toner image (toner images) onto each sheet P of recording medium, the sheet P is conveyed through this nip between the pressure roller 101 and fixation film 100 while remaining sandwiched by the pressure roller 101 and fixation film 100. As the sheet P is conveyed through this nip, it and the toner images thereon are heated. Consequently, the toner image (images) on the sheet P become fixed to the sheet P.

The fixing device 40 in this embodiment employs an image heating method which heats a sheet of recording medium and the unfixed toner image therein through a fixation film. More specifically, it has the fixation film 100 as a rotational heating member, and the pressure roller 101 as a pressure applying member. The fixation film 100 is cylindrical, and is made up of a thin metallic substrative layer. The pressure roller 101 is rotationally driven by a driving mechanism (motor). It functions as the driver roller for circularly moving the fixation film 100. That is, the fixing device 40 is structured so that the fixation film 100 is circularly moved by the rotation of the pressure roller 101.

Further, the fixing device 40 has a regulating member 102 for regulating the fixation film in its movement in its lengthwise direction, that is, the lengthwise direction of the fixing device 40. Not only does the regulating member 102 regulate the fixation film 100 in the movement in the lengthwise direction, but also, function as a guiding member for guiding the fixation film 100 in the circular movement. Hereafter, the regulating member 102 is referred to as a fixation film track regulating member 102. Further, the fixing device 40 has a film-backing member, upon which the fixation film 100 is pressed by the pressure roller 101 to form a nip between the fixation film 100 and pressure roller 101, while allowing the fixation film 100 to slide on the film-backing member by its inward surface.

The film-backing member is made up of the heater 105, a pressure bearing member 103, and a stay 104. It is disposed within the loop which the fixation film 100 forms. The fixing device 40 has also an electric power supplying member 112 (power supplying member, hereafter) for supplying the heater (electrically resistive heat generating layer) 105 with electric power. Hereafter, the combination of the fixation film 100, pressure bearing member 103, stay 104, fixation film track regulating member 102, and power supplying member 112 will be referred to as a fixation unit. The pressure bearing member 103, stay 104, and heater 105 are disposed within the loop which the fixation belt 100 forms. The power supplying member 112 is connected to the heater 105.

Next, the details of each of the abovementioned components of the fixing device 40 are given. The fixation film 100 is a cylindrical heat resistant member through which heat is transmitted to a sheet P of recording medium from the heater 105. It is loosely fitted around the fixation film track regulating member 102. The smaller in thermal capacity the fixation film 100, the quicker the fixing device 40 starts up. Thus, in order to reduce the fixation film 100 in thermal capacity, it is desired that the fixation film 100 is no more than 100 μm, preferably, no more than 20 μm, in thickness.

As the material for the substrative layer of the fixation film 100 in this embodiment, such metal as SUS is used. Incidentally, instead of employing a fixation film such as the one in this embodiment which is made up of the substrative layer and elastic layer, a single-layer film made up of PTFE, PFA, FEP, or the like, which is heat resistant, may be employed as the fixation film 100. Further, the fixation film 100 may be a cylindrical multilayer film, which is made up of a substrative layer formed of polyimide, polyamide-imide, PEEK, PES, PPS, or the like, and a surface layer formed on the outward surface of the substrative layer, of PTFE, PFA, FEP, or the like.

The pressure roller 101 is made up of a metallic core formed of a metallic substance such as iron, and a heat resistant elastic layer formed (molded) on the peripheral surface of the metallic core, of silicone rubber, fluorinated rubber, fluorinated resin, or the like. It has also a surface layer as a parting layer. As the material for the parting layer, one among fluorinated resin, silicone resin, fluorinated silicone rubber, fluorinated rubber, silicone rubber, PFA, PTFE, FEP, and the like, which are superior in parting property, and heat resistant, may be selected. The lengthwise end portions of the metallic core are fitted with a pair of supporting members, one for one, made of a heat resistant resin such as liquid polymer, and are rotatably supported.

The fixation film track regulating member 102 is made of a heat resistant resin such as PPS, LCP, or the like. The fixation film 100 is loosely fitted around the fixation film track regulating member 102, being thereby supported by the fixation film track regulating member 102 in such a manner that the fixation film 100 can be circularly moved. The fixation film track regulating member 102 flanges so that it can regulate the fixation film 100 in position in terms of the lengthwise direction of the film 100 by its flange portions. That is, the fixation film track regulating member 102 is such a member that guides the fixation film 100 as the fixation film 100 is circularly moved; as the film 100 shifts in its lengthwise direction, and comes into contact with the fixation film track regulating member 102.

The fixing device 40 in this embodiment is structured so that the fixation film track regulating member 102 can be detached from, or attached to, the main structure of the fixing device 40, by being moved away from, or toward, the main structure of the fixing device 40 in the lengthwise direction of the fixation film 100.

The pressure bearing member 103 is a heat resistant and thermal insulating member. It is roughly semicircular in cross section, and its lengthwise direction is perpendicular to the recording medium conveyance direction. As the material for the pressure bearing member 103, one of the electrically insulating and heat resistant substances such as phenol resin, polyimide resin, polyamide resin, polyamide-imide resin, PEEK resin, PPS resin, PFA, PTFE resin, LCP resin, and the like is used. It plays the role of backing up the fixation film 100 as the pressure roller 101 is pressed upon the fixation film 100 to form a nip N, to provide the fixing device 40 with the nip N having a preset amount of internal pressure. It plays also the role of ensuring that the fixation film 100 is reliably moved.

The stay 104 is a metallic member. It is kept pressed upon the pressure bearing member 103 to provide the pressure bearing member 103 with such strength that prevents the pressure bearing member 103 from being bent in the direction perpendicular to its lengthwise direction, and also, to keep the pressure bearing member 103 correct in attitude.

Basically, the heater 105 is made up of a ceramic substrate, which is in the form of a thin and long rectangular parallelepiped, and a layer of an electrically resistive substance (heat generating layer, hereafter), which generates heat as electric current is flowed through it. The heat generating layer is formed on the substrate. The heater 105 is very small in thermal capacity. Thus, as electric current is flowed through its heat generating layer, it very quickly increases in temperature. Referring to FIG. 2, the pressure bearing member 103 is provided with a groove which extends in the lengthwise direction of the pressure bearing member 103. It is positioned so that its groove faces the abovementioned nip N. The ceramic substrate of the heater 105 is fitted in this groove of the pressure bearing member 103. That is, the heater 105 is supported by the pressure bearing member 103 so that its heat generating layer faces the fixation film 100.

The heater 105 is provided with a protective layer 105*b* for protecting the heat generating layer of the heater 105, which is the surface layer of the heater 105. The protective layer 105*b* is formed of glass, for example. In the case of the fixing device 40 in this embodiment, it is this protective layer 105*b* that is the surface of the heater 105 on which the fixation film 100 slides.

One of the lengthwise end portions of the heater 105 is provided with an electrode portion 105*a* (FIG. 3) through which the heat generating layer of the heater 105 is supplied with electric power. Electric power is supplied to the electrically resistive heat generating layer by the placement of the power supplying member 112 (FIG. 1(*a*)) in contact with the electrode portion 105*a*. The power supplying member 112 has a contacting portion (electrical contact) 112*a* (shown in FIG. 1(*a*)), which is within the power supplying member 112. During a fixing operation (image heating operation), the electrically resistive heat generating layer is provided with electric power from the contact portion 112*a* through the electrode portion 105*a*. The power supplying member 112 is fixed to the pressure bearing member 103 in such manner that when it is in connection to the heater 105, it is kept pressed upon the electrode portion 105*a* of the heater 105.

The fixation film 100 is circularly moved by the rotation of the pressure roller 101, with its inward surface being kept in contact with the above-described pressure bearing member 103, and the surface (protective layer 105*b*, in particular) of the heater 105. The pressure roller 101 is pressed against the pressure bearing member 103, with the fixation film 100 being pinched between the pressure roller 101 and pressure bearing member 103, by a very large amount of pressure, for example 300 N. Thus, in order to minimize the friction between the inward surface of the fixation film 100 and the surface of the pressure bearing member 103, and the friction between the inward surface of the fixation film 100 and the surface of the heater 105, the inward surface of the fixation film 100 (or surface of the pressure bearing member 103, and surface of heater 105, on which inward surface of fixation film 100 slides) is coated with lubricant.

(Method for Replacing Fixation Film)

Figure 15:
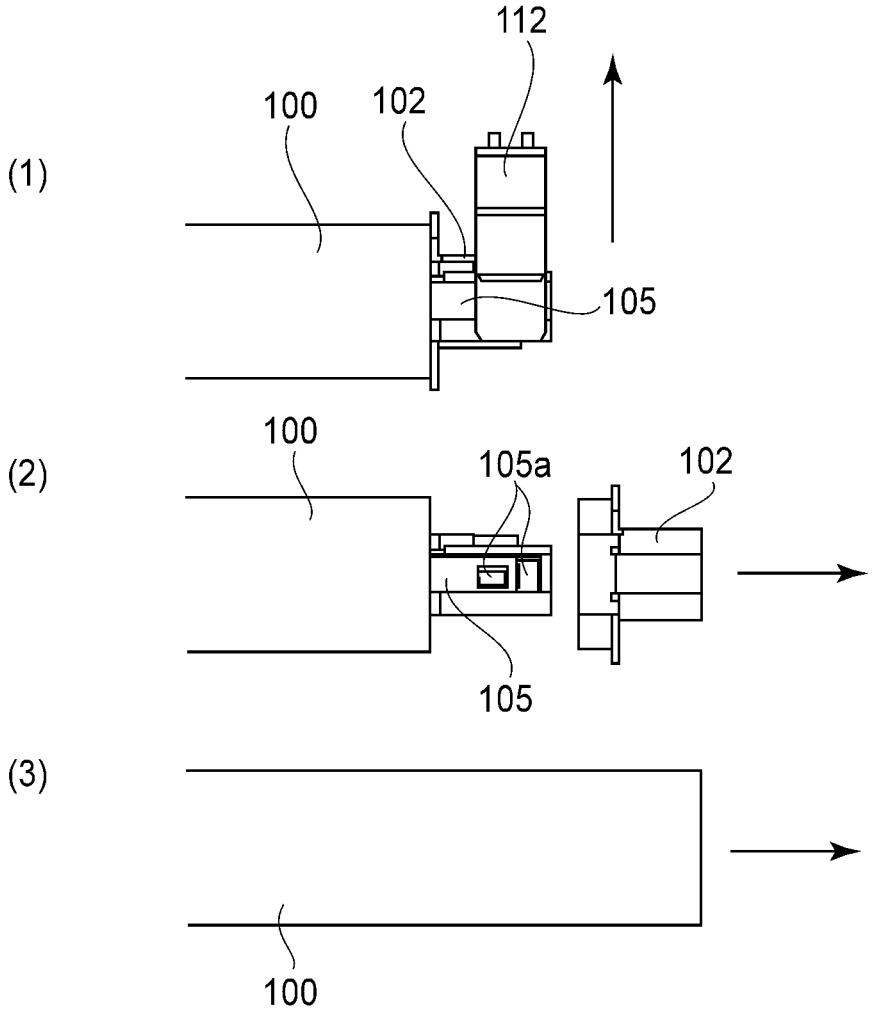
In FIGS. 15, (1)-(3) are drawings illustrating the procedure for replacing the fixation film.

Next, the procedure for replacing the fixation film 100 is described. This procedure is the same as the one described previously with reference to FIG. 15. That is, if it becomes necessary for the fixation film 100 of the fixing device 40 to be replaced because of its deterioration, first, the fixation unit of the fixing device 40 is to be moved out of the fixing device 40. Next, the power supplying member 112 is to be removed from the fixation unit (Step 1). Then, the fixation film track regulating member 102 is to be disengaged from the fixation unit (Step 2). Lastly, the fixation film 100 is removed from the fixation unit in its lengthwise direction (Step 3). This is how the deteriorated fixation film 100 is to be extracted from the fixing device 40. All that is necessary to fit the fixing device 40 with a new fixation film (replacement fixation film) 100 is to carry out the above-described steps in the reverse order.

It is possible here that in Step 3, that is, when the fixation film 100 is extracted, the lubricant on the inward surface of the fixation film 100 will adhere to the electrode portion 105*a* of the heater 105, as described before. In the case of the fixing device 40 in this embodiment, therefore, it is provided with an electrode protecting member 113, which will be described next.

(Electrode Protecting Member)

Figure 1:
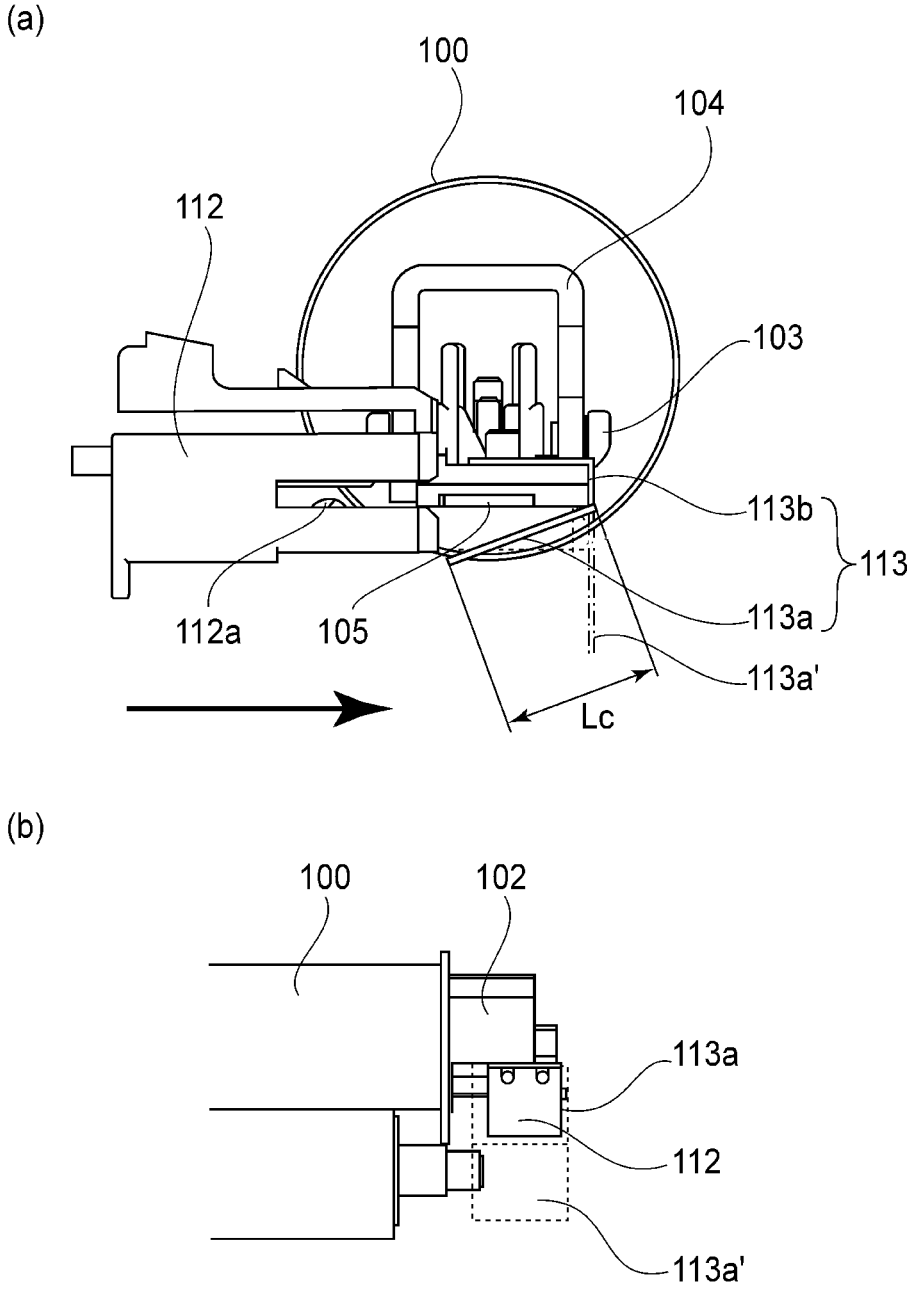
In FIG. 1, (a) is a plan view of the image heating apparatus (device) in the first embodiment of the present invention, as seen from the direction of one of the lengthwise ends of the apparatus, (more specifically, lengthwise end from which fixation film is to be extracted), and in FIG. 1, (b) is a plan view of the same portion of the image heating apparatus (device) as the one shown in FIG. 1(*a*), as seen from direction perpendicular to the lengthwise direction of the apparatus.

Referring to FIG. 1, the electrode protecting member 113, which functions as an electrode covering member, is shaped like a rectangular sheet of paper. It is disposed at the lengthwise end of the fixation unit, which corresponds in position to the electrode portion 105*a* of the heater 105. It is positioned so that it opposes the electrode portion 105*a*. It is fixed in position relative to the pressure bearing member 103, by being sandwiched by the pressure bearing member 103 and stay 104.

Next, referring to FIG. 1(*a*), the electrode protecting member 113 has a movable portion 113*a*, in addition to an immovable portion 113*b* by which the electrode protecting member 113 is held to the fixation unit. This movable portion 113*a* is the very portion of the electrode protecting member 113 that protects (covers) the electrode portion 105*a* of the heater 105. Incidentally, the drawings other than FIG. 1(*a*), which show the electrode protecting member 113, are primarily for showing the movement of the movable portion 113*a*.

Figure 3:
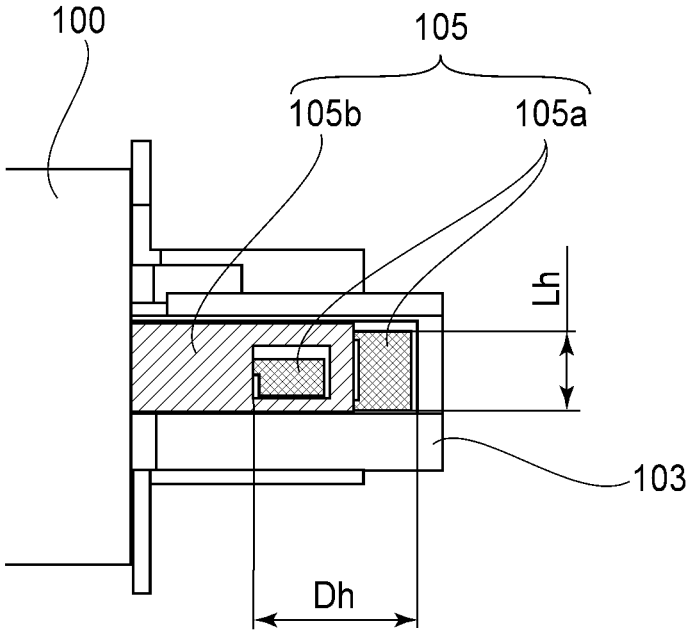
FIG. 3 is a plan view of the electrode portion of the heating member of the image heating apparatus (device) in the first embodiment, as seen from the underside of the apparatus.

FIG. 3 shows an example of the shape of the electrode portion 105*a* of the heater 105. Referential codes Dh and Lh stand for the width and length of the portion of the electrode portion 105*a* of the heater 105, which is not covered with the protective layer 105*b*, that is, the portion of the electrode portion 105*a*, with which the contact portion 112*a* (FIG. 1(*a*))

of the power supplying member 112 is placed in contact to supply the heater 105 with electric power. Next, referring to FIG. 4, referential codes Dc and Lc stand for the width and length of the movable portion 113*a* of the electrode protecting member 113. It is desired that the widths Dh and Dc, and the lengths Lh, and Lc satisfy the following conditions (inequities).

To begin with, in order for the electrode protecting member 113 to be able to completely cover the electrode portion 105*a* of the heater 105, it is desired that following relationships are satisfied: Dc>Dh, Lc>Lh. With these relationships being satisfied, it is possible to satisfactorily prevent the problem that when the fixation film 100 is removed from the fixation unit, the lubricant adheres to the electrode portion 105*a* of the heater 105.

As for the length Lc, it is desired to be long enough for the edge portion of the movable portion 113*a* of the electrode protecting member 113 to extend beyond the peripheral surface of the fixation film 100 after the disengagement of the power supplying member 112. As long as this relationship is satisfied, the electrode protecting member 113 will block the fixation film removal path, that is, the path through which the fixation film 100 is to be removed from the fixation unit by a user.

Figure 4:
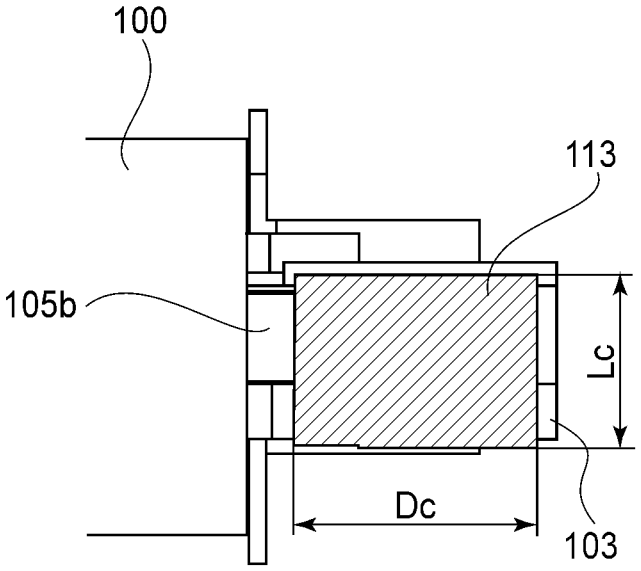
FIG. 4 is a plan view of the lengthwise end of the fixing apparatus in the first embodiment, from which the fixation film is to be extracted, as seen from the underside of the apparatus, when the electrode protecting member of the apparatus is in the first state (when protecting electrode).

The reason why the fixing device 40 (fixation unit) is to be structured as described above is that as long as the electrode protecting member 113 is positioned to block the fixation film removal path, the fixation film 100 is guided by the electrode protecting member 113 when it is removed, and therefore, it is easier for a user (operator) to remove the fixation film 100. More specifically, as the fixation film 100 is pulled outward of the fixation unit in the lengthwise direction of the fixation film 100, the electrode protecting member 113 is pushed by the fixation film 100 (being thereby forced to retract into the inward side (hollow) of the fixation belt 100 as shown in FIG. 4) before the fixation film 100 can be removed. Thus, it is ensured that when the fixation film 100 is removed from the fixation unit, the electrode portion 105*a* of the heater 105 is always protected by the electrode protecting member 113.

Figure 5:
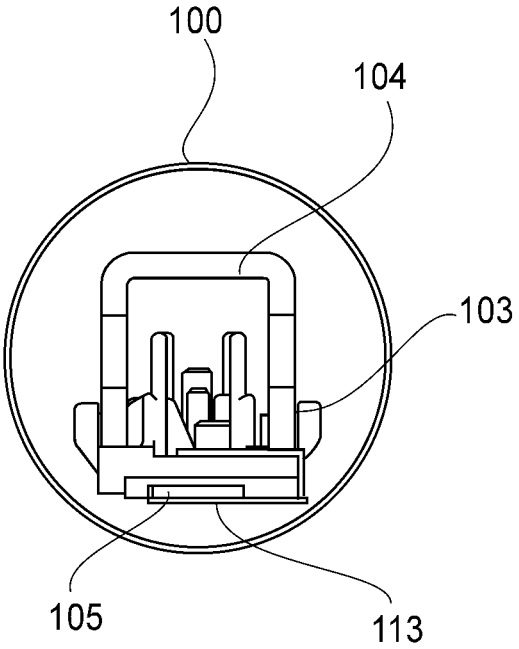
FIG. 5 is a plan view of the combination of the fixation belt and heating unit in the first embodiment, as seen from the direction perpendicular to the lengthwise direction of the apparatus, when the electrode protecting member is in the first state (when protecting electrode), into which it has been moved by the fixation belt (endless member) as the fixation belt is extracted from the fixing device.

Lastly, to describe the largest value for Dc and Lc, it is after the disengagement of the power supplying member 112, that is, when the lengthwise end portion of the fixation unit is in the state shown in FIG. 3, that the electrode protecting member 113 is allowed to move outward of the portion Dc of the movable portion 113*a*, in the lengthwise direction of the fixation film 100. Therefore, the portion Dc is desired to be smaller than the distance from the outward edge of the electrode protecting member 113 in terms of the lengthwise direction of the fixation unit, to the corresponding edge of the fixation film 100. Further, the value of the portion Lc is desired to be such that the movable portion 113*a* of the electrode protecting member 113 can be moved into the inward side (hollow) of the fixation film 100 to put the fixation unit in the state shown in FIG. 5, for example.

With the above-described relationships being satisfied, unless the electrode protecting member 113 is retracted into the inward side (hollow) of the fixation film 100 in terms of the radius direction of the fixation film 100, the fixation film 100 cannot be moved away from the fixing device 40. In other words, because the fixing device 40 is structured so that as the fixation film 100 is moved outward of the fixing device 40 in the lengthwise direction of the fixation film 100 to be extracted from the fixing device 40, the movable portion 113*a* of the electrode protecting member 113 is retracted into the inward side (hollow) of the fixation film 100 in terms of the radius direction of the fixation film 100, by the fixation film 100. Therefore, it is ensured that when the fixation film 100 is extracted from the fixing device 40, the electrode portion 105*a* of the heater 105 remains entirely covered (protected) with the electrode protecting member 113.

Figure 6:
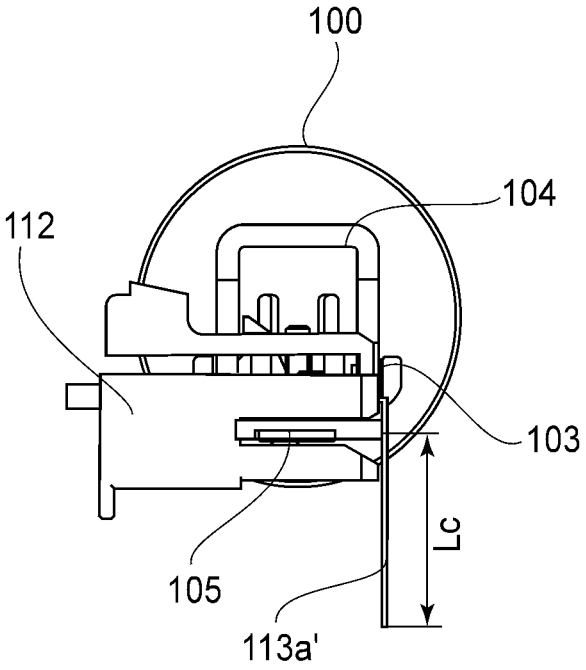
FIG. 6 is a plan view of the combination of the fixation film, heating unit, power supplying member, and electrode protecting member, when the electrode protecting member is in its second position (in which it expose (does not protect) electrode).

Further, as the power supplying member 112 is engaged with the electrode portion 105*a* of the heater 105 after the insertion of the fixation film 100 into the fixing device 40, the movable portion 113*a* of the electrode protecting member 113 is pushed by the power supplying member 112, being thereby displaced as shown in FIG. 6. That is, the fixing device 40 is structured so that the movable portion 113*a* of the electrode protecting member 113 can be pivotally moved from the position (which is referred to as "first position"), in which its movable portion 113*a* covers the entirety of the electrode portion 105*a* of the electrode 105, to the position 113*a*' (which is referred to as "second position"), in which its movable portion 113*a* allows the power supplying member 112 to be connected to the electrode portion 105*a*. That is, it is when the movable portion 113*a* of the electrode protecting member 113 is in the position 113*a*' that electric power can be supplied from the contact portion 112*a* of the power supplying member 112 to the heater 105 through the electrode portion 105*a* of the heater 105.

Embodiment 2

Figure 7:
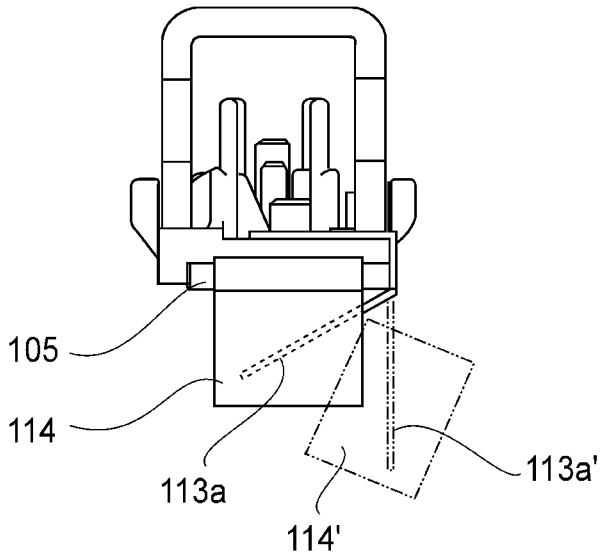
In FIG. 7, (a) is a schematic plan view of the combination of the heating unit, electrode protecting member, and film insertion facilitating member 114 of the image heating apparatus (device) in the second embodiment, when the power supplying member is engaged with, or disengaged from, the heating unit, as seen from the lengthwise direction of the fixing device (fixation film), and in FIG. 7, (b) is the lengthwise end of the fixation unit, from which the fixation film is inserted, as seen from the direction perpendicular to the fixation film insertion direction.
Figure 7:
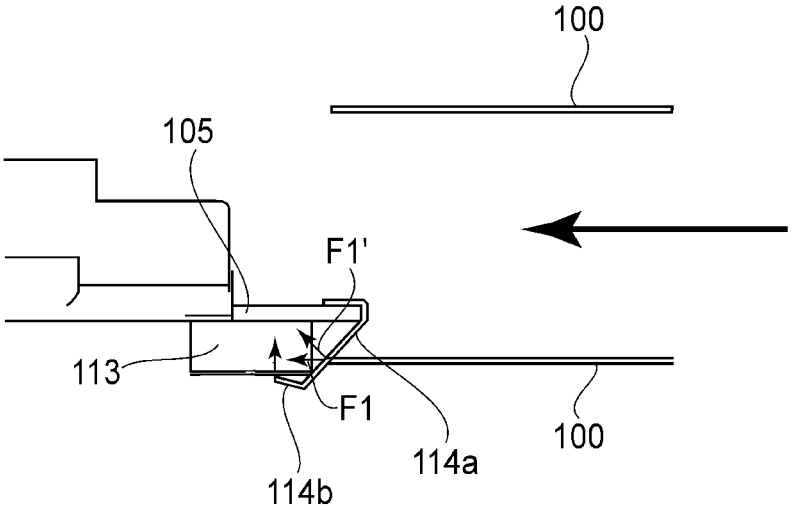

Next, referring to FIG. 7, the second embodiment of the present invention is described. FIG. 7(*b*) shows the state of the fixation film supporting portion of the fixing device 40 in this embodiment, as seen from the direction from which the fixation film 100 is inserted into the fixing device 40. FIG. 7(*a*) is a schematic plan view of the same portion of the fixing device 40 as that shown in FIG. 7(*b*), as seen from the direction indicated by an arrow mark in FIG. 7(*b*). As is evident from the drawings, the fixation film supporting portion is provided with a film insertion facilitation member 114, which is a movable member for facilitating the insertion of a replacement fixation film 100 into the fixing device 40. The film insertion facilitation member 114 has a film insertion facilitating portion 114*a* which is the very portion of the film insertion facilitation member 114 that facilitates the insertion of the fixation film 100, and a pressing portion 114*b* for causing the electrode protecting member 113 to retract.

This insertion facilitating portion 114*a* is shaped so that it is tilted downward and downstream relative to the fixation film insertion direction, and is positioned so that it can facilitate the insertion of the fixation film 100. Therefore, as an operator attempts to insert a replacement fixation film 100 into the fixing device 40, the replacement fixation film 100 comes into contact with the insertion facilitation portion 114*a*, applying thereby a force F1 to the insertion facilitation portion 114*a*, as shown in the drawing. Since the insertion facilitating portion 114*a* is tilted relative to the fixation film insertion direction as described above, the insertion facilitating portion 114*a* is subjected to a component F1' of the force F1. Consequently, insertion facilitating portion 114*a* bends in a manner to retract inward of the cylindrical fixation film 100.

In addition, the pressing portion 114*b*, which also is an integral part of the insertion facilitation member 114, like the insertion facilitation portion 114*a*, is made to come into contact with the electrode protecting member 113, and press the electrode protecting member 113, causing thereby the electrode protecting member 113 to retract inward of the cylindrical fixation film 100 along with the pressing portion 114*b*.

Therefore, it is ensured that as an attempt is made by an operator to insert the fixation film 100 into the fixing device 40, the electrode protecting member 113 is made to retract inward of the cylindrical fixation film 100 in terms of the radius direction of the fixation film 100. That is, it is ensured that when the fixation film 100 is inserted into the fixing device 40, the electrode protecting member 113 is always between the lubricant coated on the inward surface of the fixation film 100 and the electrode portion 105*a* of the heater 105. Therefore, the simple insertion of the fixation film 100 into the fixing device 40 by a person who happens to have to replace the fixation film 100 is all that is necessary to prevent the problem that when the fixation film 100 in the fixing device 40 is replaced, the lubricant adheres to the electrode portion 105*a* of the heater 105.

Moreover, the insertion facilitating portion 114*a* of the insertion facilitating member 114 is tilted downward and downstream relative to the fixation film insertion direction. Therefore, it is possible to prevent the problem that the edge of the fixation film 100 squarely collides with the insertion facilitating member 114, and the components in the adjacencies thereof. Therefore, it is possible to reduce the damages to which the edge of the replacement fixation film 100 is subjected during its insertion. Incidentally, when the power supplying member 112 is engaged with the electrode portion 105*a* of the heater 105 after the completion of the insertion of the new fixation film 100, the electrode protecting member 113 and insertion facilitating member 114 are in the position 113*a*' and 114', respectively. Therefore, the electrode protecting member 113 and insertion facilitating member 114 do not interfere with the engagement of the power supplying member 112 and the electrode portion 105*a* of the heater 105 to supply the heater 105 with electric power.

Embodiment 3

Figure 8:
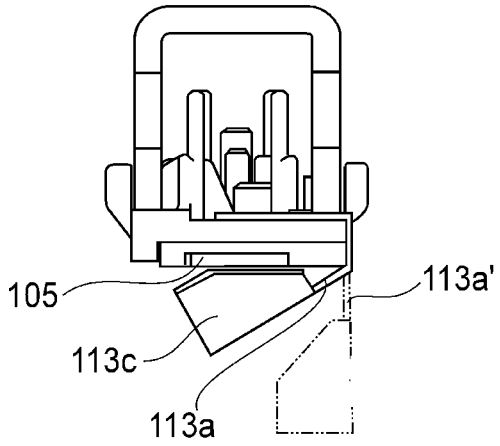
In FIG. 8, (a) is a schematic plan view of the combination of the heating unit, electrode protecting member, and film insertion facilitating member 114 of the image heating apparatus (device) in the third embodiment, when the power supplying member is engaged with, or disengaged from, the heating unit, as seen from the lengthwise direction of the fixing device (fixation film), and in FIG. 8, (b) is the lengthwise end of the fixation unit, from which the fixation film is inserted, as seen from the direction perpendicular to the fixation film insertion direction.
Figure 8:
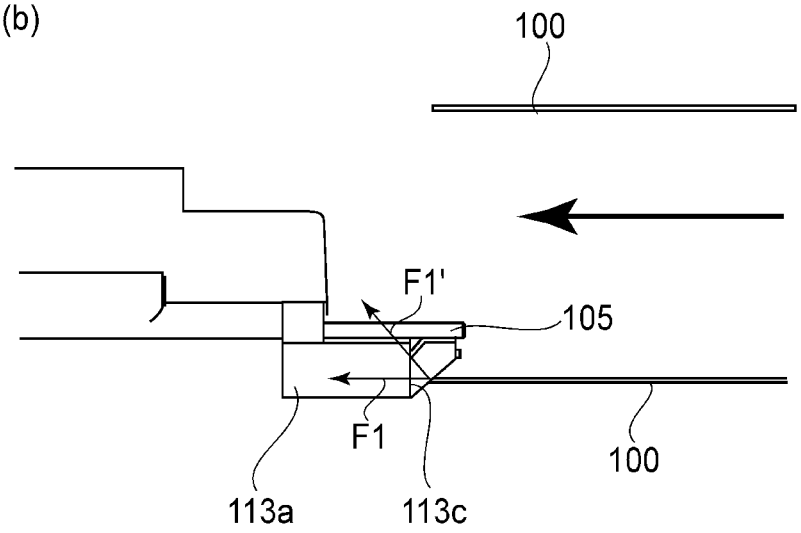

Next, referring to FIG. 8, the third embodiment of the present invention is described. FIG. 8(*b*) is a schematic plan view of the lengthwise end portion of the fixation film supporting member (unit) in the third embodiment, as seen from the direction from which the fixation film 100 is inserted into the fixing device 40. FIG. 8(*a*) is a schematic plan view of the same portion of the fixing film supporting unit as the one shown in FIG. 8(*b*) as seen from the direction indicated by an arrow mark in FIG. 8(*b*). In the second embodiment, the insertion facilitating member 114 is physically independent from the electrode protecting member 113. In this embodiment, a part 113*c* of the electrode protecting member 113 is given the function of facilitating the insertion of the fixation film 100.

That is, in this embodiment, the electrode protecting member 113 is provided with the insertion facilitating portion 113*c*, which is on the outward side of the electrode protecting member 113 in terms of the lengthwise direction of the fixing device 40. That is, the insertion facilitating portion 113*c* is a part of the upstream end portion of the electrode protecting member 113 in terms of the direction in which a new (replacement) fixation film 100 is inserted into the fixing device 40. The insertion facilitating portion 113*c* is shaped so that it is tilted downward and downstream relative to the fixation film insertion direction. Therefore, as the fixation film 100 is inserted into the fixing device 40, first, it comes into contact with the insertion facilitating portion 113*c*, and presses on the insertion facilitating portion 113*c* by a force F1. Thus, the insertion facilitating portion 113*c* is subjected to a component F1' of the force F1. Thus, the insertion facilitating portion 113*c* is pushed upward, being thereby made to retract into the hollow of the fixation film 100 by the force F1'.

Therefore, simple insertion of the fixation film 100 into the fixing device 40 is all that is necessary to prevent the lubricant from adhering to the electrode portion 105*a* of the heater 105 while the fixation film 100 is inserted into the fixing device 40, as it is in the second embodiment.

Embodiment 4

Figure 9:
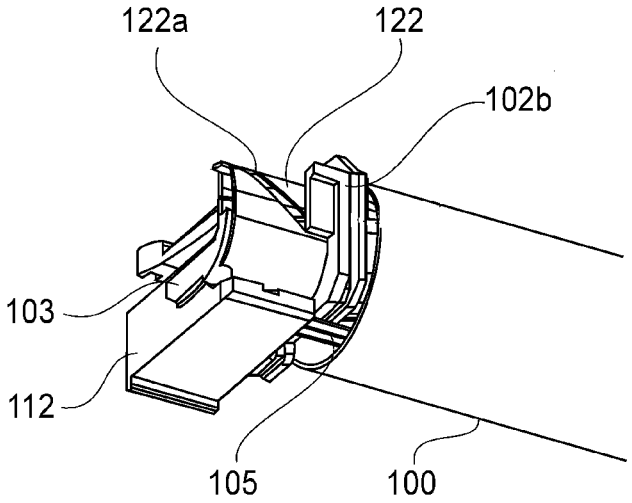
FIG. 9 is a schematic perspective view of the portion of the fixing device in the fourth embodiment, which is directly involved in the replacement of the endless film.
Figure 10:
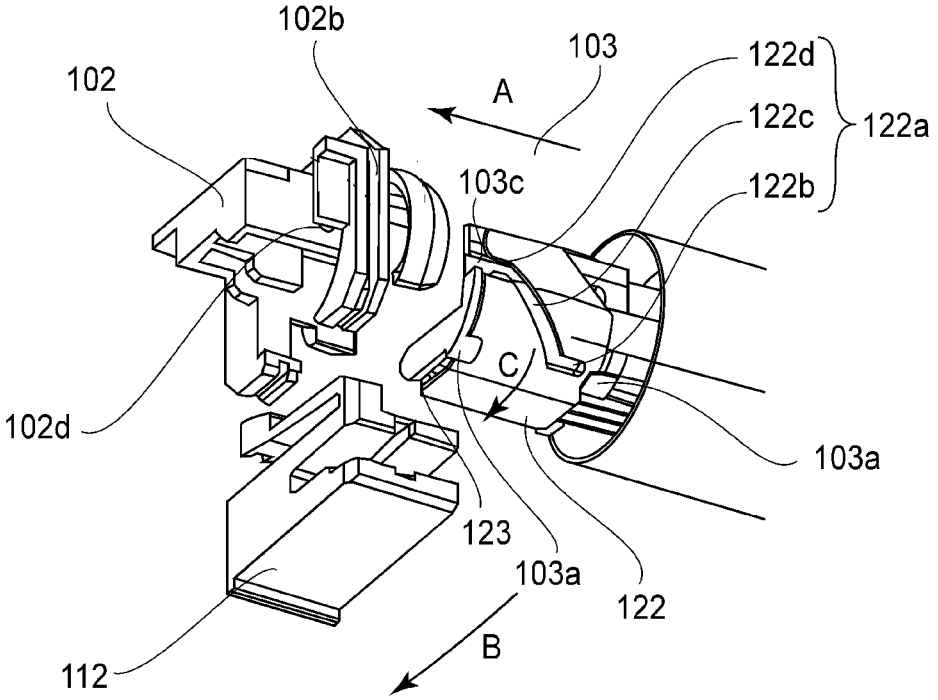
FIG. 10 is an exploded perspective view of the portion of the fixing device in the fourth embodiment, which is directly involved in the replacement of the endless film, and shows how the components of this portion can be disassembled.
Figure 11:
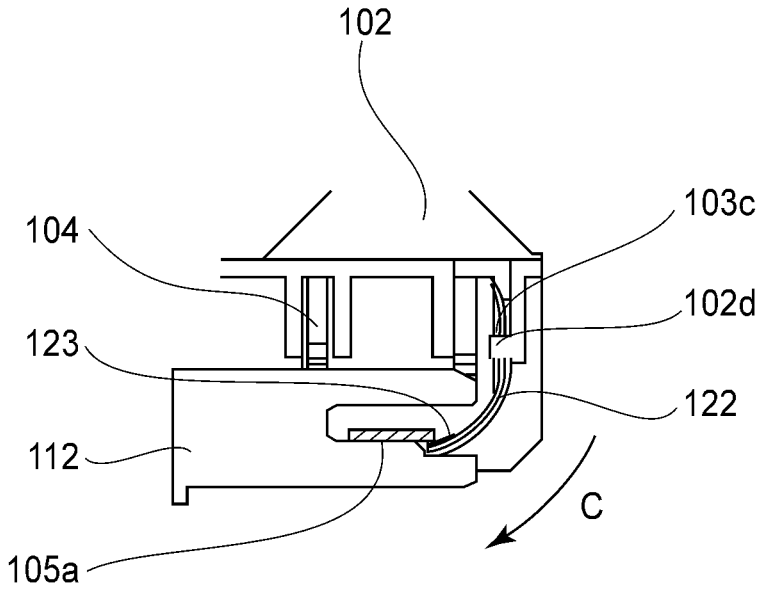
FIG. 11 is a schematic sectional view of the portion of the fixing device in the fourth embodiment, which is directly involved in the replacement of the fixation film, when the electrode protecting member is in the second state (exposing electrode portion) while the power supplying member is attached.
Figure 12:
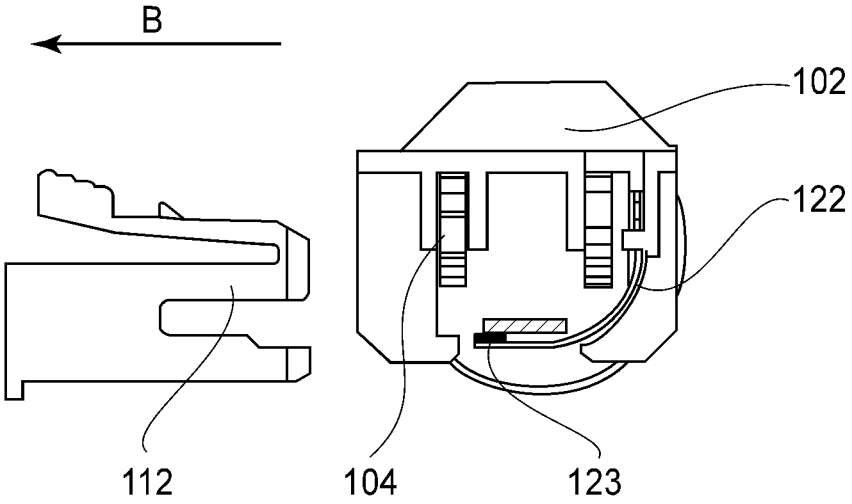
FIG. 12 is a partially exploded schematic sectional view of the portion of the fixing device in the fourth embodiment, which is directly involved in the replacement of the fixation film, when the electrode protecting member is in the first position (protecting (covering) electrode portion), while the power supplying member is detached.
Figure 13:
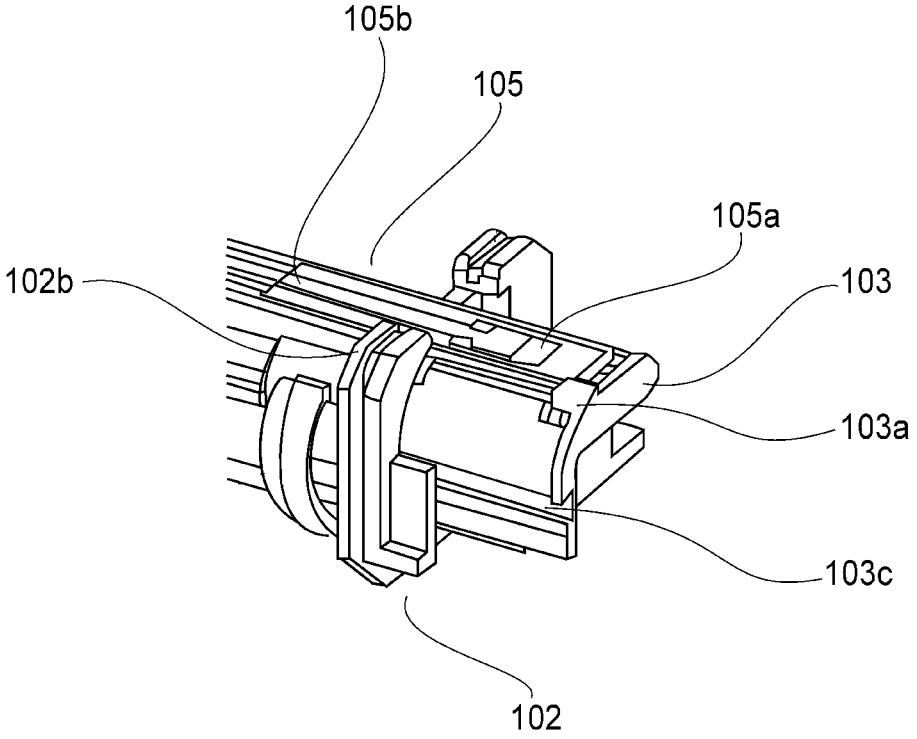
FIG. 13 is a perspective view of one of the lengthwise end portions of the fixation film supporting portion of the fixing device in the first embodiment.

Next, referring to FIGS. 9-13, the fourth embodiment of the present invention is described. FIG. 9 is a schematic perspective view of the portion of the fixing device 40 in this embodiment, which is directly involved in the replacement of the fixation film. FIG. 10 is an exploded perspective view of the portion of the fixing device in this embodiment, which is directly involved in the replacement of the fixation film. It shows how this portion can be disassembled. FIG. 11 is a schematic sectional view of the portion of the fixing device in this embodiment, which is directly involved in the replacement of the fixation film. FIG. 12 is a partially exploded schematic sectional view of the portion of the fixing device in this embodiment, which is directly involved in the replacement of the fixation film 100.

Referring to FIG. 10, the first step to be carried out to replace the fixation film 100 in the fixing device 40 is to disengage the power supplying member 112 from the fixation film supporting unit, in the direction indicated by an arrow mark in the drawing, because the power supplying member 112 is on the downstream side of the flange portion 102*b* of the fixation film track regulating member 102, in terms of the direction in which the fixation film 100 is to be extracted from the fixing device 40.

The next step to be taken is to remove the fixation film track regulating member 102 (in the direction indicated by arrow mark A). This step is necessary because the flange portion 102*b* for regulating the movement of the fixation film 100 in the direction parallel to the rotational axis of the fixation film 100 is a part of the fixation film track regulating member 102.

Referring to FIG. 11, the fixation film track regulating member 102 is coupled with the stay 104 in such a manner that it can be moved relative to the fixation unit in the direction indicated by the arrow mark A as described above. The fixation film track regulating member 102 is provided with protrusion 102*d*, which protrudes toward the pressure bearing member 103. The pressure bearing member 103 is provided with a slide-guide 103*c*, which guides the protrusion 102*d* of the fixation film track regulating member 102, guiding thereby the fixation film track regulating member 102. Thus, the fixation film track regulating member 102 can be moved in the direction indicated by the arrow mark A, being guided by the stay 104 and the slide-guide 103*c* of the pressure bearing member 103, and remaining in the same attitude as the one in which it was set.

Next, the role of a shutter 122 is described, which is the same as the role of the above described electrode protecting member 113 which protects the electrode portion 105*a* of the heater 105 when the fixation film track regulating member 102 is removed. Referring to FIG. 10, the protrusion 102*d*, with which the fixation film track regulating member 102 is provided is coupled with the slide-guide 103*c*, with which the pressure bearing member 103 is provided, and also, with the slit 122*a* with which the shutter 122 is provided.

The shutter 122 is a thin and flexible member. It is made of resin, metal, etc. It is held by the shutter guide 103*a*, with which the pressure bearing member 103 is provided, in such a manner that it can be moved along the outward surface of the fixation film 100 in the circumferential direction of the fixation film 100. Therefore, as the shutter 122 comes into contact with the protrusion 102*d* of the fixation film track regulating member 102, it is pushed by the protrusion 102*d*, being thereby moved relative to the pressure bearing member 103 in the direction indicated by an arrow mark C. The movement of the shutter 122, which is caused by the removal of the fixation film track regulating member 102, will be described later.

When the power supplying member 112 is in connection to the fixation unit (FIG. 11), the shutter 122 is in its retreat (home position). Therefore, the surface of the electrode portion 105*a* of the heater 105 remains exposed, being therefore enable to supply the heater 105 with electric power. That is, it is in contact with the contact portion 112*a* of the power supplying member 112. Further, the protrusion 102*d* (FIG. 10) of the fixation film track regulating member 102 remains fitted in the slit 122*a* of the shutter 122, regulating thereby the shutter 122 in its movement in the rotational direction of the fixation film 100.

Next, the movement of the shutter 122, which is caused by the movement of the fixation film track regulating member 102 when the fixation film track regulating member 102 is removed from the fixation unit, is described. As the fixation film track regulating member 102 is moved in the direction indicated by an arrow mark A in FIG. 10, the protrusion 102*d* of the fixation film track regulating member 102 comes out of the fixation film track regulating member positioning portion 122*b* of the slit 122*a*, and moves into the slanted portion 122*c* of the slit 122*a*.

As the fixation film track regulating member 102 is moved further in the direction indicated by the arrow mark A, with the protrusion 102*d* remaining in the slanted portion 122*c* of the slit 122*a*, the portion of the shutter 122, which has the slanted portion 122*c* of the slit 122*a*, is pushed by the protrusion 102*d* of the fixation film track regulating member 102. Thus, the shutter 122 moves in the direction indicated by an arrow mark C in FIGS. 10 and 11.

That is, as the fixation film track regulating member 102 is moved in the direction indicated by the arrow mark A in FIG. 10, the shutter 122 is moved in the direction indicated by the arrow mark C in FIG. 10, by the movement of the fixation film track regulating member 102, with the protrusion 102*d* of the fixation film track regulating member 102 remaining in the fixation film track regulating member insertion opening portion 122*d* of the slit 122*a*. Thus, the shutter 122 is moved into the position (FIG. 12) in which it covers (protects) the electrode portion 105*a* of the heater 105. That is, the shutter 122 is disengaged from the pressure bearing member 103, making it possible for the fixation film track regulating member 102 to be removed from the fixation unit.

With the positional relationship among the abovementioned components being kept as described above, it is ensured that when the fixation film 100 is extracted from the fixing device 40, the electrode portion 105*a* is protected by the shutter 122. That is, when the inward surface of the fixation film 100 passes over the electrode portion 105*a*, the electrode portion 105*a* is protected from the adhesion of the contaminants (lubricant) such as grease.

(Cleaning Member)

Referring to FIGS. 11 and 12, the surface of the shutter 122, which faces the electrode portion 105*a* of the heater 105, is provided with a cleaning member (cleaning portion) 123. As the shutter 122 is moved, the cleaning member 123 comes into contact with the surface of the electrode portion 105*a*, and wipes clean the surface of the electrode portion 105*a* as it moves with the shutter 122. The cleaning member 123 is made of a heat resistant substance, for example, unwoven cloth made of aramid fiber, foamed silicone rubber, PPS or the like resin.

Next, the effects of the cleaning member 123 are described in detail. As described above, in order to remove the fixation film 100 from the fixation unit, the power supplying member 112 has to be removed from the fixation unit. The power supplying member 112 is in contact with the electrode portion 105*a* of the heater 105 to supply the heater 105 with electric power during an image heating period, and is kept pressed against the pressure bearing member 103. Therefore, when the power supplying member 112 is engaged with, or disengaged from, the electrode portion 105*a*, the power supplying member 112 and electrode portion 105*a* rub against each other, producing thereby particled shavings or the like. If the particled shavings are present between the electrode portion 105*a* and power supplying member 112, it is possible that the electrical connection between the electrode portion 105*a* and power supplying member 112 will become abnormal.

In this embodiment, however, when the shutter 122 is moved along the pressure bearing member 103, the cleaning member 123 removes the contaminants on the electrode portion 105*a* by moving with the shutter 122 while remaining in contact with the electrode portion 105*a*. Therefore, it is ensured that the electrical connection between the electrode portion 105*a* and power supplying member 112 remains satisfactory.

The cleaning member 123 in this embodiment is a sheet of foamed silicone rubber, unwoven cloth, or the like. However, this embodiment is not intended to limit the present invention in terms the shape of the cleaning member 123. That is, all that is required of the cleaning member 123 in terms of shape is that the cleaning member 123 is shaped so that it can easily remove the contaminants on the electrode portion 105*a*. For example, the cleaning member 123 may be different in shape from the one in which it is in this embodiment, in such a manner that its cleaning edge can be placed in contact with the electrode portion 105*a* at an acute angle.

Referring to FIG. 2, in the above described first to fourth embodiments of the present invention, a pair of power supplying members 112 are disposed at the lengthwise ends of the fixation film 100, one for one, and so are the electrode protecting member (shutter) 122. This structural arrangement was made to enable the fixation film 100 to be extracted from the fixing device 40 in either direction in terms of its lengthwise direction. However, these embodiments are not intended to limit the present invention in the direction, in terms of the lengthwise direction of the fixation film 100, in which the fixation film 100 is to be extracted from the fixing device 40. That is, the fixing device 40 may be designed so that the fixation film 100 can be extracted only in one direction in terms of the lengthwise direction of the fixation film 100, and only the lengthwise end of the fixation unit, from which the fixation film 100 is to be extracted, is provided with the electrode protecting member (shutter) 122.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 270304/2012 filed Dec. 11, 2012, which is hereby incorporated by reference.

What is claimed is:

1. An image heating apparatus comprising:

a replaceable endless belt configured to heat a toner image on a sheet in a nip portion, an inner surface of said endless belt being coated with a lubricant;

a rotatable member configured to form the nip cooperatively with said endless belt;

a back-up member provided in said endless belt and configured to back-up said endless belt to sandwich said endless belt cooperatively with said rotatable member;

a heater provided on said back-up member and configured to heat said endless belt;

an electrode portion provided on said back-up member and configured to be electrically connected with said heater;

a detachable connector configured to supply electric power to said heater through said electrode portion;

a covering member configured to cover said electrode portion when said endless belt is pulled out from said back-up member in a state that said connector is detached from said back-up member; and a film insertion facilitation member, abuttable with said endless belt, configured to facilitate insertion of a new replacement endless belt replacing the replaceable endless belt by interrelating a movement of said covering member from a first position for permitting a connection between said connector and said electrode portion to a second position for covering said electrode portion with an inserting operation of the new replacement endless belt.

2. The apparatus according to claim 1, wherein said film insertion facilitation member is provided on said covering member.

3. The apparatus according to claim 1, wherein said covering member is moved from the second position to the first position with an operation of mounting said connector to said back-up member.

4. The apparatus according to claim 1, wherein a portion of said covering member is mounted to said back-up member so as to be rotatable between the first position and the second position.

5. The apparatus according to claim 1, further comprising a driving mechanism configured to drive said rotatable member, wherein said endless belt is rotated by said rotatable member driven by said driving mechanism.

6. The apparatus according to claim 1, wherein said electrode portion is provided adjacent to a side of said back-up member, said endless belt being slidable on said side of said back-up member.

7. The apparatus according to claim 1, further comprising a detachable regulating member configured to regulate a movement of said endless belt in a widthwise direction of said endless belt by abutting with an edge of said endless belt, wherein said covering member covers said electrode portion when said endless belt is pulled out from said back-up member in a state that said connector and said regulating member are detached from said back-up member.

* * * * *